US008042675B2

(12) United States Patent
Gonzalez Alemany et al.

(10) Patent No.: US 8,042,675 B2
(45) Date of Patent: Oct. 25, 2011

(54) SELF-SUPPORTING GUIDING SYSTEM FOR MOVING WALKWAYS

(75) Inventors: Miguel Angel Gonzalez Alemany, Oviedo (ES); Juan Domingo Gonzalez Pantiga, Gijon (ES); Manuel Alonso Cuello, Gijon (ES); José Ojeda Arenas, La Fresneda-Siero (ES); Mónica Diaz Sorribas, Gijon (ES)

(73) Assignees: Thyssenkrupp Elevator Innovation Center, S.A., Asturias (ES); Thyssenkrupp Elevator (ES/PBB) Ltd., London (GB)

( * ) Notice: Subject to any disclaimer, the term of this patent is extended or adjusted under 35 U.S.C. 154(b) by 295 days.

(21) Appl. No.: 12/247,762

(22) Filed: Oct. 8, 2008

(65) Prior Publication Data

US 2009/0101470 A1 Apr. 23, 2009

(30) Foreign Application Priority Data

Oct. 18, 2007 (ES) ..... 200702739

(51) Int. Cl.
*B66B 23/22* (2006.01)

(52) U.S. Cl. ..... 198/332; 198/333; 198/860.1

(58) Field of Classification Search ..... 198/326, 198/332, 333, 860.1
See application file for complete search history.

(56) References Cited

U.S. PATENT DOCUMENTS

| | | | | | |
|---|---|---|---|---|---|
| 4,064,986 | A * | 12/1977 | Bertovich | 198/326 |
| 4,484,674 | A * | 11/1984 | Lunardi et al. | 198/332 |
| 4,726,460 | A * | 2/1988 | Otomo | 198/328 |
| 4,739,870 | A * | 4/1988 | Saito | 198/328 |
| 4,958,473 | A * | 9/1990 | Iyoda | 52/646 |
| 5,295,568 | A * | 3/1994 | Saito et al. | 198/330 |
| 6,234,295 | B1 * | 5/2001 | Ogawa | 198/333 |
| 6,374,981 | B1 * | 4/2002 | Gschwendtner et al. | 198/321 |
| 6,405,848 | B1 * | 6/2002 | Babler | 198/333 |
| 6,814,215 | B2 * | 11/2004 | Krampl | 198/321 |
| 7,159,705 | B2 * | 1/2007 | Ogimura et al. | 198/326 |
| 7,441,644 | B2 * | 10/2008 | Aulanko et al. | 198/335 |
| 7,513,356 | B2 * | 4/2009 | Veit et al. | 198/370.02 |
| 7,703,594 | B2 * | 4/2010 | Stein | 198/321 |

FOREIGN PATENT DOCUMENTS

| | | |
|---|---|---|
| EP | 1074 507 | 2/2001 |
| WO | WO 2005/070810 | 8/2005 |

* cited by examiner

*Primary Examiner* — Douglas Hess
(74) *Attorney, Agent, or Firm* — Merchant & Gould P.C.

(57) ABSTRACT

The invention relates to a system having: a first longitudinal member and a second longitudinal member arranged symmetrical to the first longitudinal member in relation to a longitudinal mid-plane of the conveyor system, to define a forward movement track and a return track of the rollers (4); a connecting crossbeam (6) for connecting the longitudinal members. The longitudinal members have: an upper surface defining the forward movement track (2) on which the rollers (4) roll; a lower surface defining the return track (3) on which the rollers (4) roll; an inner surface provided with means for fixing the longitudinal members; an outer surface. The first longitudinal member is connected to the second longitudinal member by means of a connecting crossbeam (6) to ensure a necessary tolerance between longitudinal members.

20 Claims, 6 Drawing Sheets

SELF-SUPPORTING GUIDING SYSTEM FOR MOVING WALKWAYS

This application is claims benefit of Serial No. 200702739, filed 18 Oct. 2007 in Spain and which application is incorporated herein by reference. To the extent appropriate, a claim of priority is made to the above disclosed applications.

FIELD OF THE INVENTION

The present invention relates to a self-supporting guiding system for moving walkways comprising a plurality of pallets provided with rollers for guiding movement of the pallets.

BACKGROUND OF THE INVENTION

In a walkway designed according to the traditional concept, all the elements forming it are fixed to a frame built with welded profiles forming a lattice with the necessary dimensions for supporting the loads of its own weight, the guiding elements, the drive, the enclosures of the walkway and the load of the users on the conveyor pallets.

The main problem with this concept is the inaccuracy it creates, requiring many hours for adjusting each of the parts linked to the frame such that they provide correct guidance for the pallets as well as easy assembly of the upper frame. Besides the complexity of the assembly, very precise and very complex tools are needed both for installing the assembly accurately enough and for manufacturing the actual frame.

Since the frame according to the traditional concept is manufactured in lattice form from structural profiles, a frame needs a large number of different parts for manufacture, making the assembly difficult and increasing the costs of the materials.

Finally, a walkway with a frame of welded structural profiles is very heavy, the total loads therefore not being completely optimized. Not only is the frame designed to support the weight of the parts forming the mechanism of the walkway but to also support its own weight.

Patent application EP1074507A1 proposes a walkway aimed at solving part of the problems of the traditional concept by means of frames of side panels forming a lattice and arranged laterally to the track of the pallets or steps of stairs. These side panels are joined to one another by means of welded crossbeams forming a closed frame. In addition to being expensive and rather non-productive, it is not compatible with the manufacture of modular frames or with field assembly due to the fact that it uses welded frames.

Other types of walkways have been proposed to solve these problems as disclosed in patent WO05070810A2. This patent describes a metal profile on which the tracks for the pallets transporting the users are directly manufactured. One of the features of this concept is the absence of a cover; the outer walls of the profile directly form the enclosures of the walkway and will therefore be exposed to all the external agents that the cover of a walkway is normally exposed to. Any damage to the outer walls of the profile requires the replacement of the entire profile, generating expensive and extremely complicated maintenance.

Furthermore, the use of the walls of the profile as the enclosure does not allow customizing the enclosure according to the demand, such enclosure being conditioned to the appearance of the actual guiding profile and to its dimensions, preventing different configurations thereof.

Using the guiding profile as a cover for the actual walkway means that when the walkway is underground it is impossible to access each of the supports to regulate it, making said walkway configuration impossible and allowing only one possible walkway configuration above ground level.

Patent document WO05070810 proposes the use of the same guiding profile and frame for supporting the glass of the handrail. This involves the use of excessive material considering that the supports for the glass are usually discrete and it would entail continuous support.

Patent document WO05070810 proposes a moving walkway with a frame manufactured from an extruded metal profile which can be used for guiding the pallets of the moving walkway, the support rollers of the pallets rolling on said extruded profile.

Extrusion is a process that makes it difficult to use steel because it obliges using considerably smooth shapes and considerable thicknesses, making it virtually impossible to manufacture a profile complying with all the requirements demanded of the guide concept of patent document WO05070810 in steel. Aluminum on the other hand presents problems as to its behavior regarding wear when it is used as a guide against the support rollers of the pallet.

The aluminum frame has much lower resistance than a steel frame and therefore, in comparative terms, a frame manufactured in aluminum must have more frequent supports than a frame manufactured in steel. This involves a larger number of parts and a more complicated assembly.

An extruded profile requires slides for assembling the screws that will secure the screwed connections and therefore wastes a large amount of material in the walls thereof that are not required in most of the length of the profile since the connections are only in certain points.

Making an aluminum profile entails increased costs because this metal has a high cost in comparison with its strength.

SUMMARY OF THE INVENTION

The object of the present invention is to eliminate the frame of welded profiles traditionally used for moving walkways and stairs and all the problems it entails by means of a metal profile including the upper and lower tracks for guiding the pallets transporting users of the walkway or stairs. Hereinafter, the generic term pallet comprises both the plates of moving walkways and the steps of stairs.

With a profile like the profile of the present invention, a reliable and accurate track can be obtained that is self-supporting, eliminating the traditional frame.

The profile has a track for the upper pallet section and another track for the lower section, separated from one another by the necessary distance so that the pallets can pass with enough clearance in relation to the connecting crossbeam with the symmetrical profile. The tracks are finished at their end farthest from the pallets with an inclined wall transversely guiding the pallets transporting users.

There are screwed in the upper surface of the profile and in the side surface discrete parts on which the glass of the moving walkway, the cover of the walkway and the inner base are secured. Having a discrete profile allows not only optimizing the material used in relation to the inclusion of said support in the continuous lower profile but also using other manufacturing processes such as casting, forging or press forming. These processes are more appropriate for producing discrete parts, which allows providing reinforcements and boreholes and anchors for both the glass of the walkway and for the outer cover. If these parts were manufactured using manufacturing processes for constant section profiles, later machining processes would be required which would considerably increase the cost and time for manufacturing them.

The enclosure of the walkway is not directly formed by the guide profile, but the cover is arranged separately, assembled on the discrete parts or on the side of the guide profile. Different cover configurations can thus be adopted depending on if the walkway is underground or above ground, or it can even adopt a possible special configuration in terms of both geometry and finishes. The cover adapted to each of the options allows optimizing the amount of material used given that in the event that the walkway is underground, the cover ends in the ground and material that would otherwise be unnecessary would not be arranged underground. Separating the cover of the guide profile allows providing parts that can be replaced in the event of damage due to external agents which would otherwise oblige replacing the complete profile. The support of the cover is carried out either on the discrete part supporting the handrail or on the outer surface of the guide profile.

When the walkway is arranged in an underground configuration, the regulation of the lower supports of the profile can easily be accessed by dismantling the cover because a space is provided allowing such access between the actual cover and the area of the profile farthest from the track. In addition, elongated holes are also included in the upper face of the profile allowing access to said supports, allowing the regulation from the inside.

Another elongated hole is arranged in the lower face which is used for the assembly of the support part of the walkway which will rest on the ground of the slab in which it is arranged or on a reinforcing frame.

Each profile and its symmetrical profile are assembled by means of a crossbeam which is laterally screwed to elongated holes, leaving the necessary tolerance between the tracks for correct guiding between the rollers transporting the pallets of the moving walkway.

The profile has two internal bends. One of them will be used for carrying cables along the length of the walkway and another one will be used for arranging the supports such that it does not involve an increase of the effective height of the walkway when it is arranged directly on the ground.

The guide profile is manufactured by rolling and subsequent laser welding, a process which provides considerably more versatility than other steel profile manufacturing processes such as extrusion; the use of said metal is therefore much more viable and more suited for the application than other lightweight metals such as aluminum.

Steel is much stronger in comparison with aluminum; it therefore allows increasing the distance between supports to ensure that the profile does not undergo any bending that exceeds that allowed. This involves a savings in total parts in the supports and in the assembly time.

The rolled profile will be designed with longitudinal elongated holes which allow assembling profiles with one another, with the connecting crossbeams, with the supports on the ground, on a reinforcing frame or with other discrete parts assembled directly on the profile. If the profile were extruded, the parts assembled thereon would have to be assembled either on elongated holes which would require machining after extrusion or on roller paths from the extrusion entailing using material in areas in which it is not needed since the roller paths are continuous and the anchors are discrete.

The behavior of the steel for receiving the running of the rollers of the pallet is much more reliable against the wear caused by the running on aluminum.

The elongated holes necessary for the connection between consecutive profiles by means of parts that are partially introduced in each of them and are screwed to the elongated holes of the ends of the profiles will also be carried out during rolling. This connection between profiles can be carried out with one or several parts and even with parts which preserve continuity on the outer part of the guide profiles, also screwed to the elongated holes resulting from the rolling.

BRIEF DESCRIPTION OF THE DRAWINGS

A series of drawings is described below which aid in better understanding the invention and are expressly related to an embodiment of said invention presented as a non-limiting example thereof.

DETAILED DESCRIPTION OF THE PREFERRED EMBODIMENTS

Figure 1:
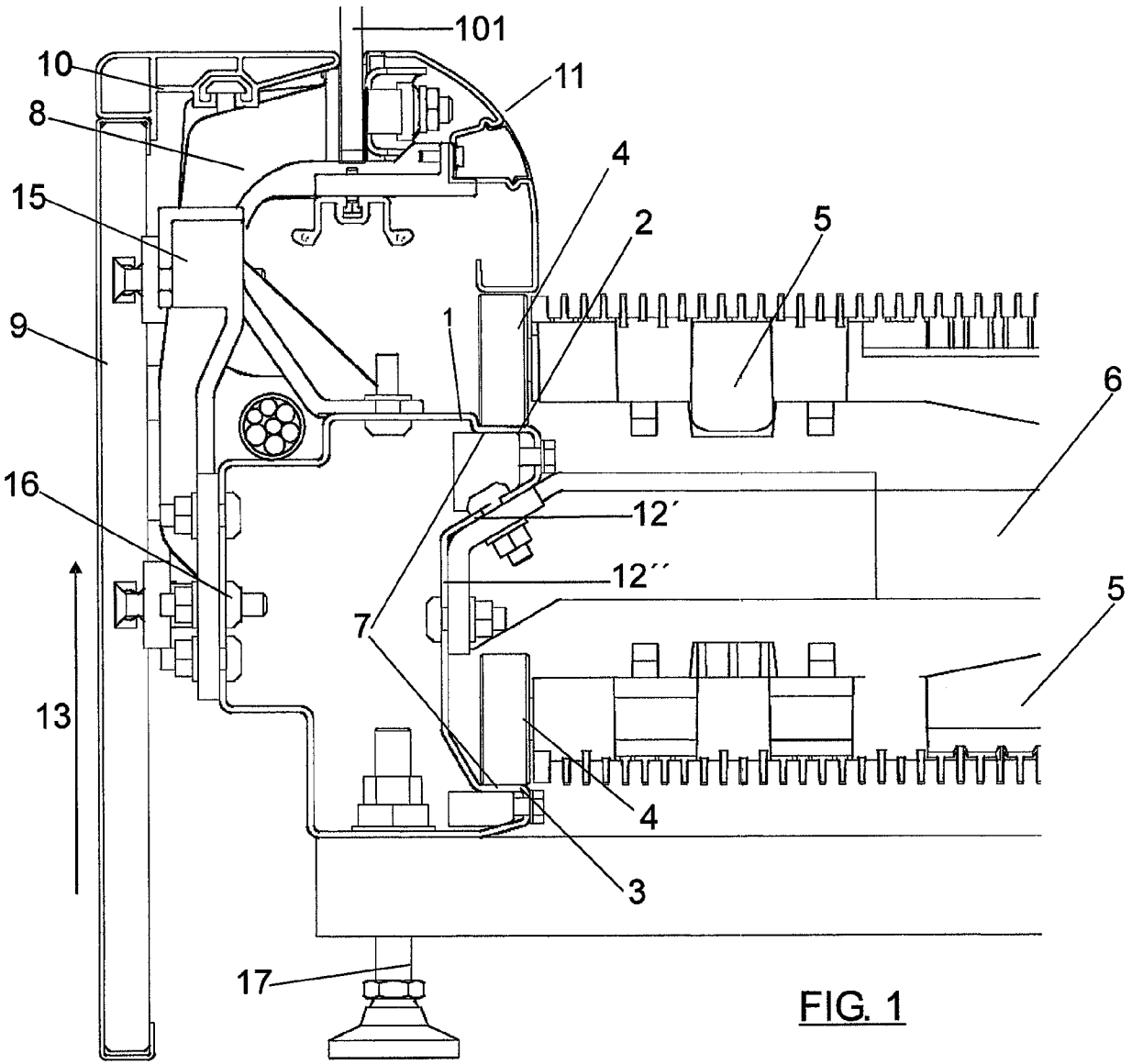
FIG. 1 is a section of the walkway with the guide profile, the discrete handrail support, the cover and the supports of the walkway.

As can be seen in FIG. 1, the longitudinal guide members have a forward movement track, or upper track and a return track, or lower track, on which the support rollers 4 of the pallets 5 transporting users roll. Each longitudinal guide member has a symmetrical longitudinal member, both being connected by a connecting crossbeam 6 ensuring the distance between the guiding noses 7 of both longitudinal members.

There are screwed on the upper face of each longitudinal member and on its outermost face discrete parts 8 acting as a support for the glass of the handrail and as a support for the outer cover 9, for the outer profile 10 and for the base 11.

The longitudinal members are longitudinal members comprising a plurality of profiles arranged laterally one after another to define a closed longitudinal member cross section contour. The longitudinal members are manufactured by rolling and subsequent laser welding of the profiles forming them, providing the necessary tolerances and allowing the absence of regulation in the assembly. In addition, these profiles have in their two inner surfaces, a third inclined surface 12' and a second vertical surface 12", to fix the position of the crossbeam 6 in relation to the profile 1 both vertically and transversely to the movement of the walkway.

The fact that the cover is separate from the guide profile allows adopting different configurations cutting the profile at different levels in the vertical direction 13 depending on the level at which the ground is located.

The cover can be fixed to the handrail support part 8 by means of anchoring surfaces 15 coming out of said part or even to the outer surface 16 of the guide profile. The outer profile 10 is screwed in the same manner to the discrete support part 8.

Figure 2:
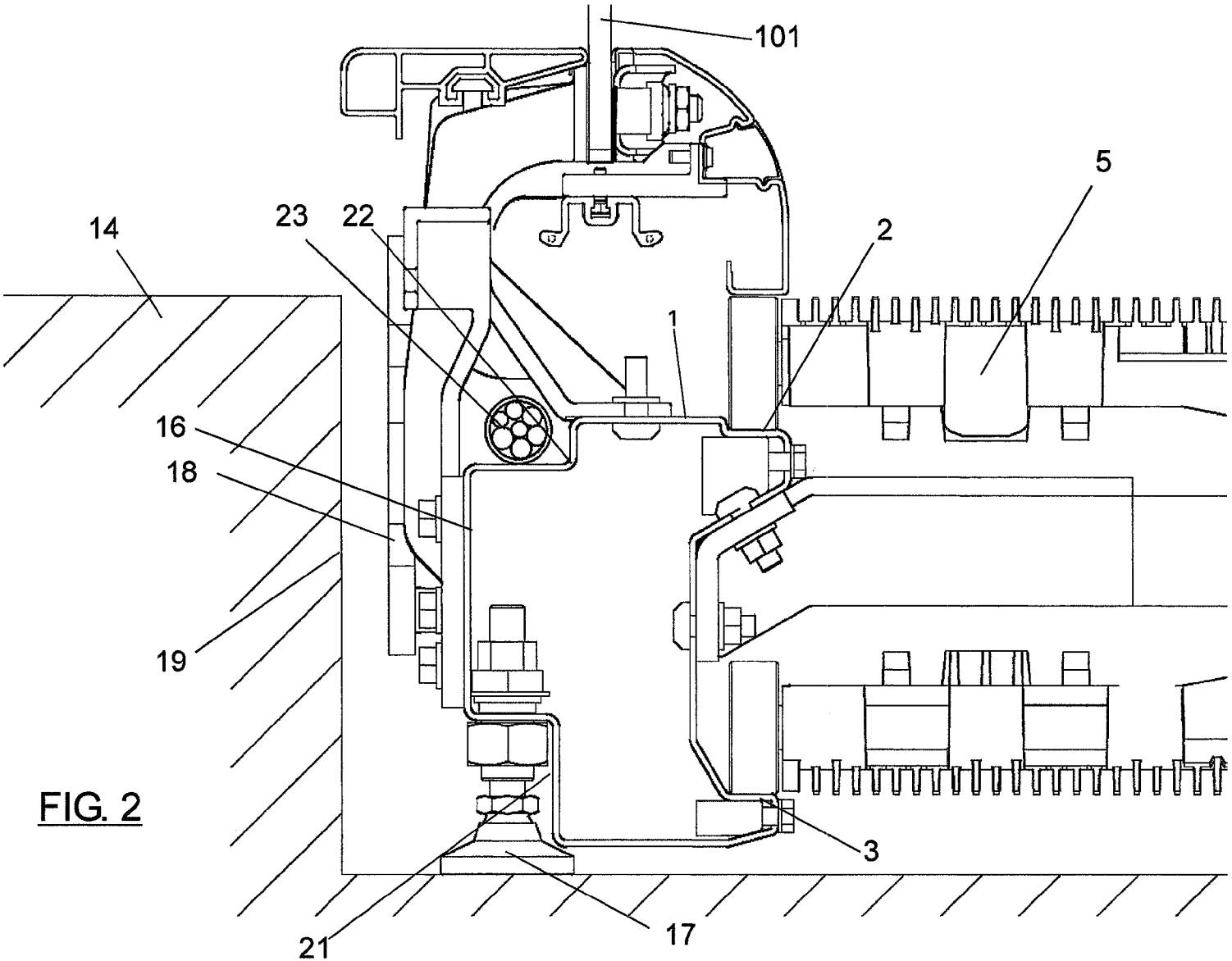
FIG. 2 is a section of the underground walkway with access to the support of the walkway.

FIG. 2 shows an underground walkway with the pallets 5 at ground level 14. In this case, the supports 17 of the walkway can be accessed through the space 18 between the side 16 of the profile and the pit 19

Figure 3:
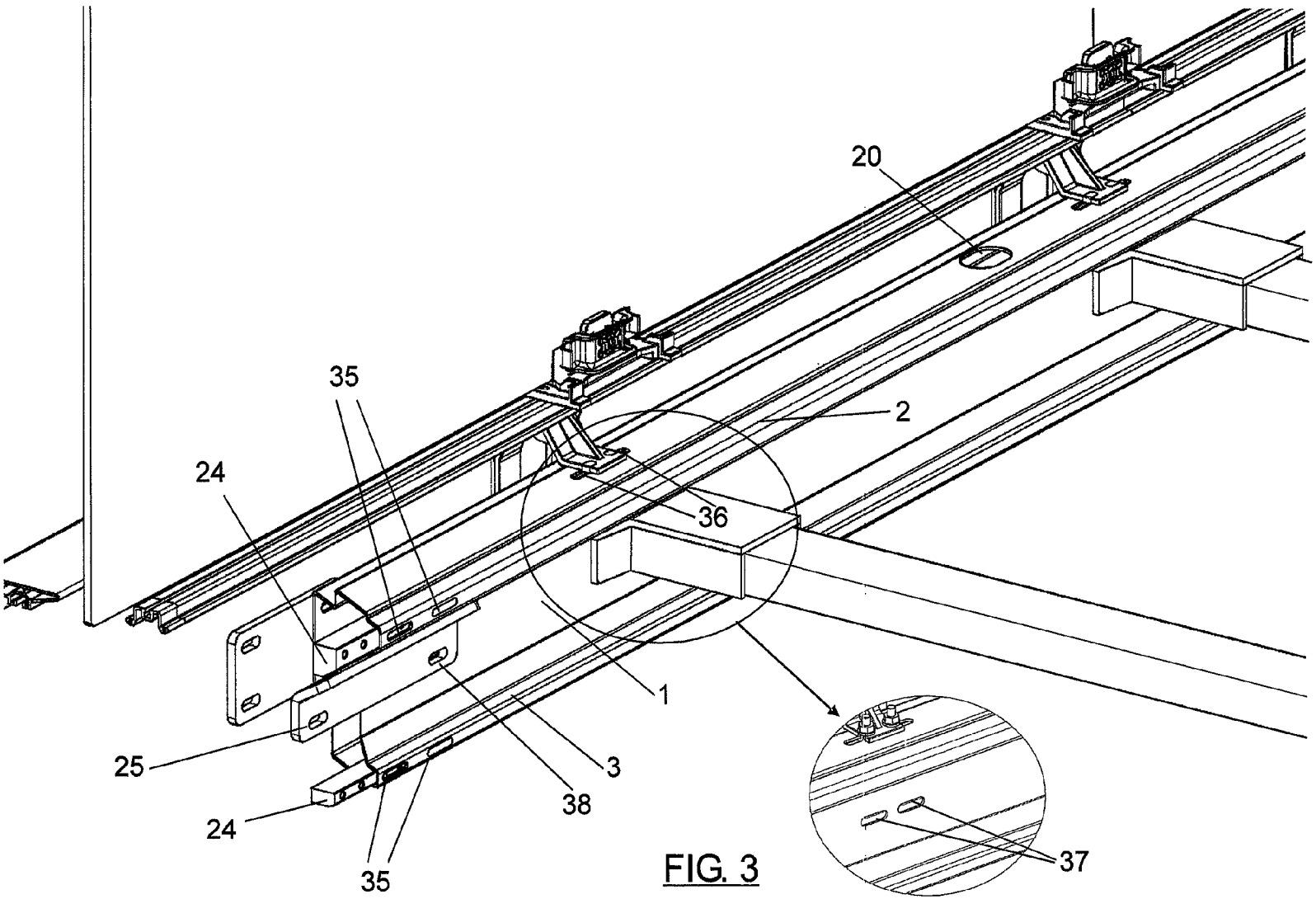
FIG. 3 is an isometric view of the profile with the crossbeams and the glass assembled.

FIG. 3 also shows one of the elongated holes 20 located in the upper part of the profile to allow regulation of the supports from the upper area of the profile. To regulate the supports from these upper elongated holes, other elongated holes are arranged in alignment with the former at the lower part on which the supports 17 of the walkway are screwed in the event that there is sufficient space, as in the case of FIG. 1.

If there is no space available under the walkway, the profile 1 has a first internal bend 21 for housing the support of the walkway and reducing the effective height of the walkway as in FIG. 2. In this case, the support is regulated by the space 18.

A second internal bend 22 is equally included in the profile such that the cables 23 which have to be distributed along the entire length of the walkway can be housed.

The guide profiles can be connected to one another by means of connecting parts 24 carried out as shown in FIG. 3. In this figure it can be seen how the parts tongue and groove with the guide profile such that when screwed together they become compacted with one another, allowing them to work as a single unit. The track is further provided with continuity by means of the miter cut 26.

The profiles can also be connected to one another by means of external connections 25 which are screwed directly to the elongated holes through both the inner part and the outer part of the profile.

Figure 5:
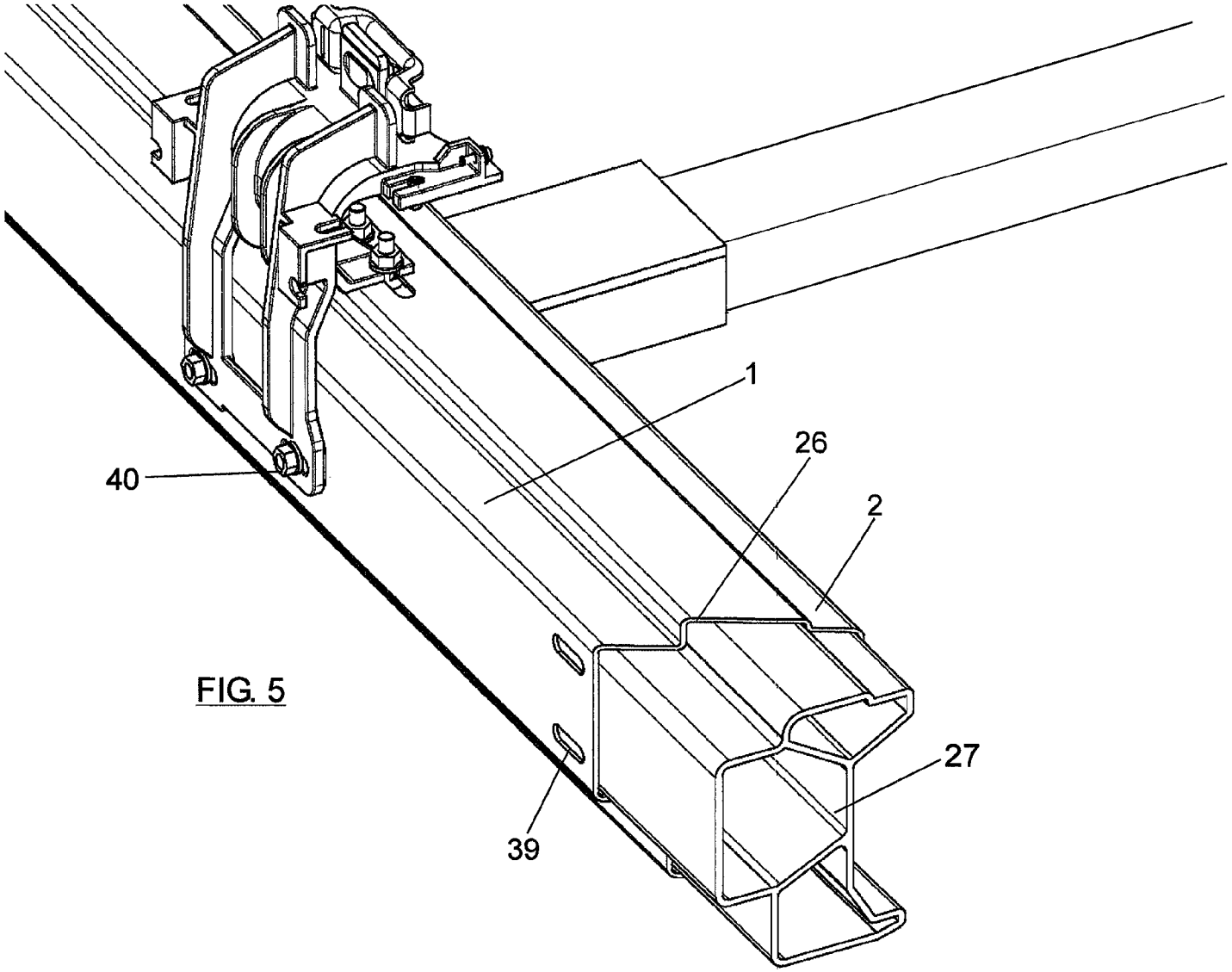
FIG. 5 depicts a continuous part which, tongued and grooved with the guide profile, performs the connection between profiles.
Figure 6:
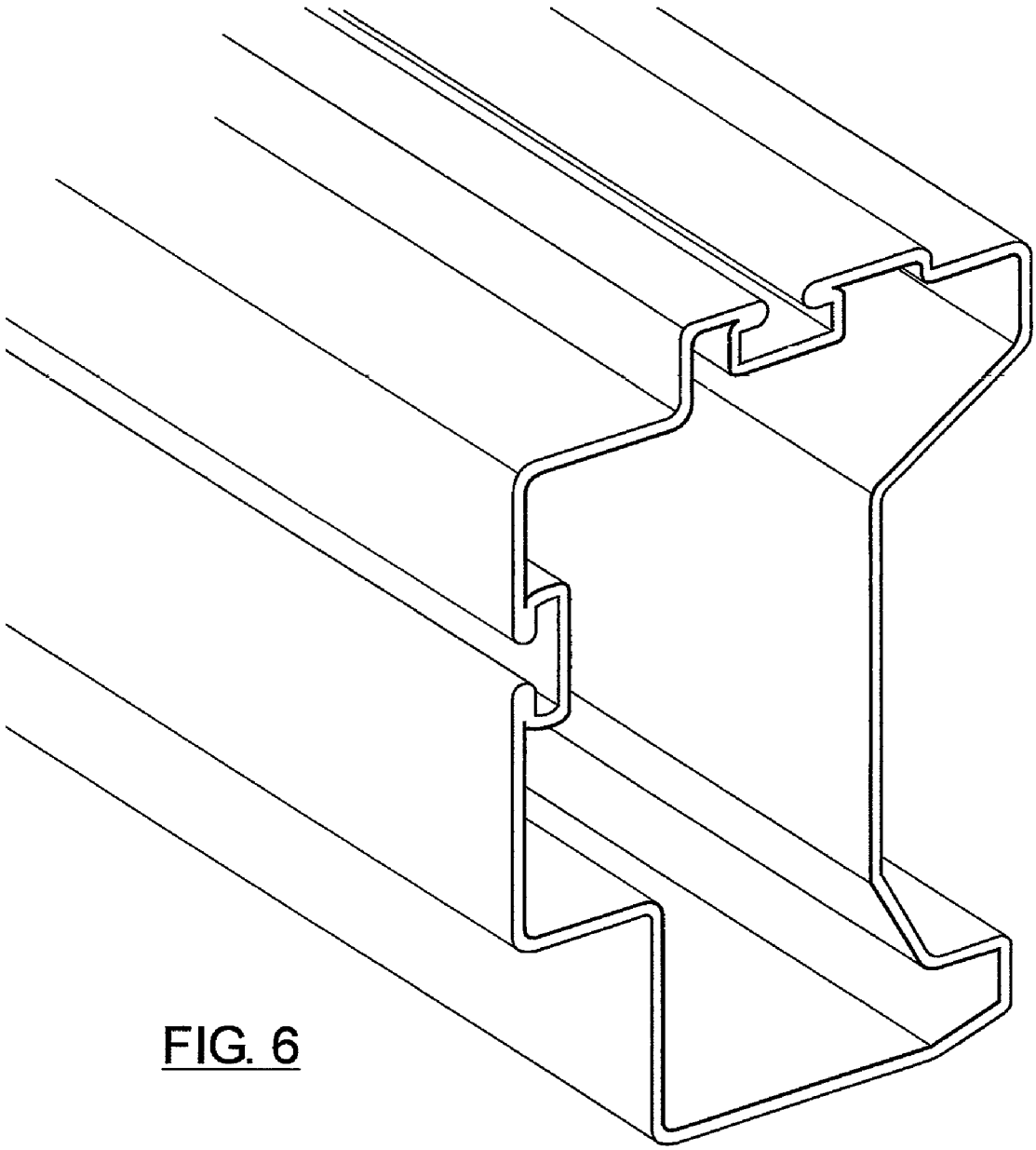
FIG. 6 depicts a type of anchor of the parts adjacent to the longitudinal member by means of a T-shaped roller path.

As in the case of FIG. 5, a profile 27 the shape of which coincides with the inside of the guide profile 1 can be arranged, making the tongue and grooving between two contiguous profiles complete.

Figure 4:
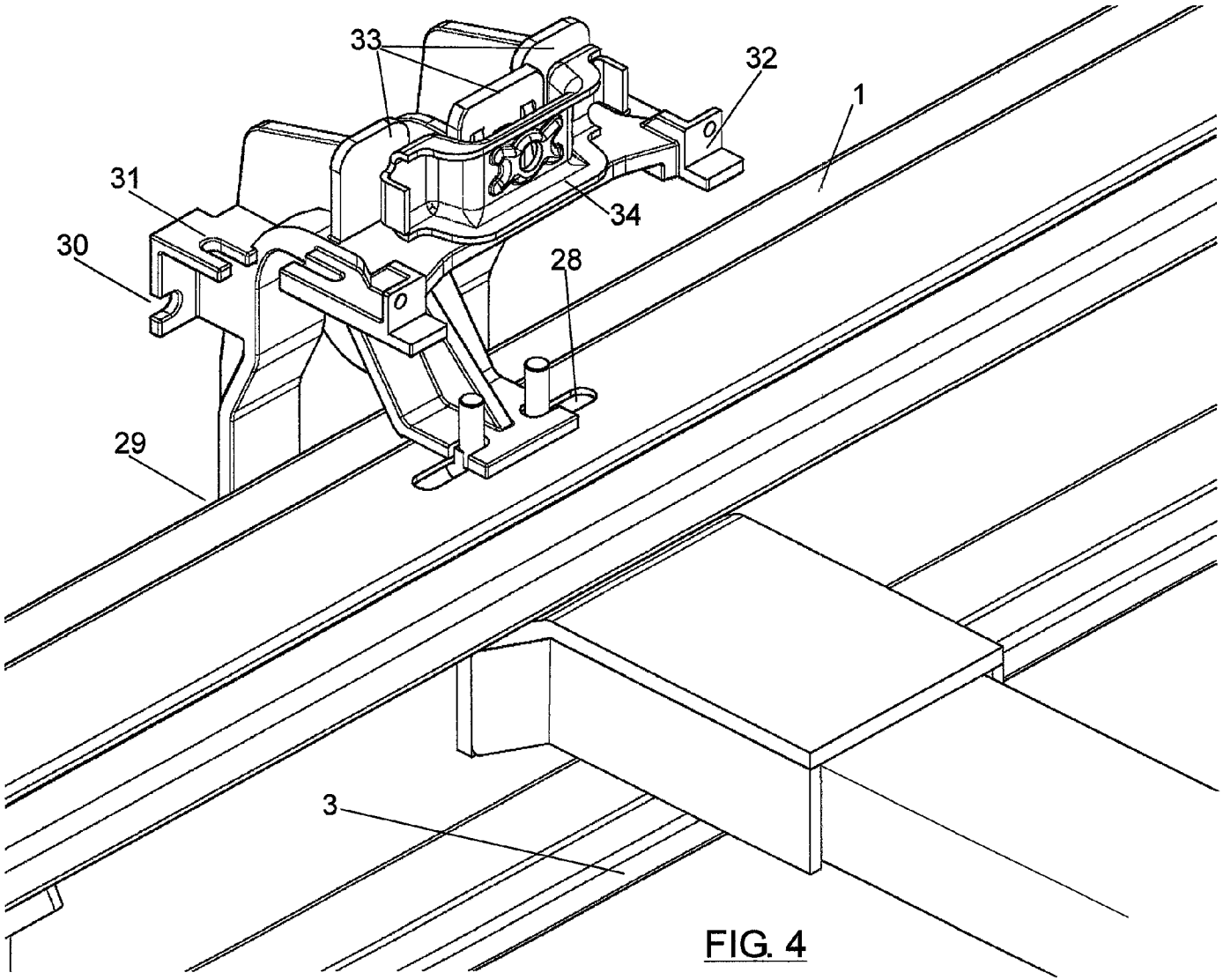
FIG. 4 is an isometric view of the discrete support part of the handrail.

FIG. 4 shows an image of the discrete support part of the handrail which is screwed to the upper part 28 of the profile and to the outer part 29.

The bases for securing the following parts come out of this part:

- Fastening for the outer cover 30 which is carried out on the outer part of the support part.
- The outer profile is screwed to an elongated hole 31 which is arranged in the upper part of the support part.
- The base is referenced to the guiding path on supports 32 that are precise enough to arrange it in relation to the outer grooves of the pallet.
- The glass is arranged between three alternating flanges 33, a clamp 34 being fixed to the central flange such that it presses the glass against the other two flanges, fixing it with sufficient force.

FIG. 3 shows an image of the rolled profile 1 in which a series of elongated holes are punched:

- There are arranged in the surface adjacent to both tracks two longitudinal elongated holes 35 such that they prevent the movement in the direction of the walkway of both profiles in relation to the connecting part, whether the latter is just one in number 27 or is divided into two or more parts 24.
- There are located in the upper face two elongated holes 36 defining the position of the support part of the handrail.
- Elongated holes 37 are used in the inner face of the guide profile to fix the connecting crossbeam 6 and the connecting parts 38 between consecutive profiles.
- Connecting parts can be used to fix two adjacent profiles in the outer area by means of elongated holes 39 as well as the outer fastening of the support part 40 of the handrail.

All these holes are punched during rolling, preventing any type of machining on the manufactured profile and therefore preventing any unnecessary cost. The elongated holes can also be replaced with T-shaped roller paths 41 such that the connection can be carried out at any point of the profile.

One embodiment of the invention thus relates to a self-supporting guiding system for a conveyor system by means of pallets 5 provided with rollers 4 for guiding movement of the pallets 5. As previously mentioned, the generic term pallet comprises both plates of walkways and steps of stairs. The guiding system or frame comprises:

- a first longitudinal member and a second longitudinal member arranged symmetrical to the first longitudinal member in relation to a longitudinal mid-plane of the conveyor system, to define a forward movement track and a return track of the rollers 4;
- at least one connecting crossbeam 6 for connecting the longitudinal members;

wherein the longitudinal members comprise:

- an upper surface comprising the forward movement track 2 on which the rollers 4 roll;
- a lower surface comprising the return track 3 on which the rollers 4 roll;
- an inner surface comprising means for fixing the longitudinal members;
- an outer surface;
- the first longitudinal member is connected to the second longitudinal member by means of at least one connecting crossbeam 6 to ensure a necessary tolerance between longitudinal members.

In an alternative of the invention, at least one of the two longitudinal members comprises at least one surface 7 forming an angle ≧90° with at least one of the two tracks 2, 3 on each side of the roller 4 to prevent a transverse movement of the pallets 5.

In another alternative of the invention, at least one of the two longitudinal members comprises at least one surface 7 forming an angle ≧90° with at least one of the two tracks 2, 3, on one side of the roller 4 to prevent a transverse movement of the pallets 5.

The means for fixing the longitudinal members additionally comprise a plurality of first elongated holes 37.

The longitudinal members likewise comprise a plurality of profiles arranged laterally one after another to define a closed longitudinal member cross section contour. The longitudinal members have a constant cross section.

The inner surface of the longitudinal members has a first vertical surface 12" and a third surface selected from inclined and horizontal 12' configured to form a transverse and vertical reference for positioning of the connecting crossbeam 6.

There is supported on a surface selected from the upper surface 28, the outer surface 29 and combinations thereof a discrete part 8 screwed to a plurality of second elongated holes 36 configured for:

- securing an enclosure 9 of the system;
- supporting a glass forming the handrail 101 of the system;
- supporting an outer profile 10;
- supporting a base of the system 11.

The enclosure of the system is screwed to an element selected from the discrete part 8, the side of the longitudinal members, and combinations thereof to allow different configurations depending on the position of the system in relation to the ground or the product finishing needs.

A large enough space is left between the enclosure 9 and the outside of the longitudinal members so as to access the support of the system when the system has an underground configuration.

The discrete part 8 is manufactured by means of a process selected from casting, forging, press forming and combinations thereof.

The system of the invention additionally comprises:

- a plurality of third elongated holes 17' in the lower surface on which the supports 17 of the system are assembled on a location selected from the ground, a reinforcing frame and combinations thereof;
- a plurality of fourth elongated holes 20 in the upper surface 28 to allow access to a regulation of the support 17.

The longitudinal members comprise a first internal bend 21 to provide a space in which there is arranged the support 17 of the system to reduce an effective height of the system.

The longitudinal members comprise a second internal bend 22 to provide a space through which the cables circulate for the operation of the system.

The longitudinal members are connected to one another by means of parts 27 copying an internal geometry of the longitudinal members, said parts 27 overlapping between two contiguous longitudinal members, each of the parts 27 being screwed to at least one fifth elongated hole 39 of each contiguous longitudinal member.

The longitudinal members are connected by connecting parts 25 which externally connect two contiguous longitudinal members being screwed to sixth elongated holes 35 in the running direction of the system.

At least one of the connecting crossbeams 6 is manufactured by means of a process selected from machining, extrusion, rolling, casting and combinations thereof.

The longitudinal members are manufactured by rolling.

According to one alternative, the elongated holes 20, 39 and the anchors in the areas of the elongated holes 37, 36, 17', 35 are obtained by punching during the rolling process.

According to another alternative, the elongated holes 20, 39 are obtained by punching and the anchors in the areas of the elongated holes 37, 36, 17', 35 are carried out by means of a T-shaped roller path 41 during the rolling process.

The discrete support part 8 comprises in an upper part at least three flanges 33 arranged on alternating sides of the handrail configured to press the handrail by means of at least one clamp screwed to the flanges of one side of the handrail 101 against the flanges of the other side of the handrail 101 to fix the handrail 101 to the frame.

The invention claimed is:

1. A self-supporting guiding system for moving walkways by way of pallets provided with rollers for guiding movement of the pallets, comprising:

a first longitudinal member and a second longitudinal member arranged symmetrical to the first longitudinal member in relation to a longitudinal mid-plane of the system to define a forward movement track and a return track of the rollers, wherein the first and second longitudinal members comprise: an upper surface comprising the forward movement track on which the rollers roll; a lower surface comprising the return track on which the rollers roll; an inner surface comprising means for fixing the longitudinal members; an outer surface; and a discrete part screwed to a plurality of first elongated holes located on a surface of the longitudinal members selected from the upper surface, the outer surface, and combinations thereof, the discrete part configured for securing an enclosure of the system, supporting a glass forming a handrail of the system, supporting an outer profile, and supporting a base of the system; and at least one connecting crossbeam for connecting the longitudinal members.

2. The system of claim 1, wherein at least one of the two longitudinal members comprises at least one surface forming an angle of ≧90° with at least one of the two tracks on each side of the roller to prevent transverse movement of the pallets.

3. The system of claim 1, wherein at least one of the two longitudinal members comprises at least one surface forming an angle of ≧90° with at least one of the two tracks on one side of the roller to prevent transverse movement of the pallets.

4. The system of claim 1, wherein the means for fixing the longitudinal members comprise a plurality of second elongated holes.

5. The system of claim 1, wherein the longitudinal members comprise a plurality of profiles arranged laterally one after another to define a closed longitudinal member cross section contour.

6. The system of claim 1, wherein the longitudinal members have a constant cross section.

7. The system of claim 1, wherein the inner surface of the longitudinal members has a first vertical surface and a second surface selected from inclined and horizontal configured to form a transverse and vertical reference for positioning of the connecting crossbeam.

8. The system of claim 1, wherein the discrete part comprises in an upper part at least three flanges arranged on alternating sides of the handrail configured to press the handrail by means of at least one clamp screwed to the flanges of one side of the handrail against the flanges of the other side of the handrail to fix the handrail to the frame.

9. The system of claim 1, wherein the enclosure of the system is screwed to an element selected from the discrete part, a side of the longitudinal members, and combinations thereof.

10. The system of claim 1, wherein a large enough space is left between the enclosure and an outside of the longitudinal members to access the support of the system when the system has an underground configuration.

11. The system of claim 1, wherein the discrete part is manufactured by means of a process selected from casting, forging, press forming and combinations thereof.

12. The system of claim 1, wherein it comprises:

a plurality of lower elongated holes in the lower surface on which the supports of the system are assembled on a location selected from the ground, a reinforcing frame, and combinations thereof;

a plurality of upper elongated holes in the upper surface to allow access to a regulation of the support.

13. The system of claim 12, wherein the longitudinal members comprise a first internal bend to provide a space in which the support of the system is arranged to reduce an effective height of the system.

14. The system of claim 1, wherein the longitudinal members comprise a second internal bend to provide a space through which cables circulate for the operation of the system.

15. The system of claim 1, wherein the longitudinal members are connected to one another by means of parts copying an internal geometry of the longitudinal members, said parts overlapping between two contiguous longitudinal members, each of the parts being screwed to at least one elongated hole of each contiguous longitudinal member.

16. The system of claim 1, wherein the longitudinal members are connected by means of connecting parts which externally connect two contiguous longitudinal members being screwed to elongated holes in the running direction of the system.

17. The system of claim 1, wherein at least one of the connecting crossbeams is manufactured by means of a process selected from machining, extrusion, rolling, casting and combinations thereof.

18. The system of claim 1, wherein the longitudinal members are manufactured by rolling.

19. The system of claim 18, wherein the plurality of first elongated holes and anchors in areas of a plurality of second elongated holes are obtained by punching during the rolling process.

20. The system of claim 18, wherein the plurality of first elongated holes are obtained by punching and anchors in the areas of a plurality of second elongated holes are manufactured by means of a T-shaped roller path during the rolling process.

* * * * *